US007361097B2

(12) United States Patent
Hot

(10) Patent No.: US 7,361,097 B2
(45) Date of Patent: Apr. 22, 2008

(54) MAGNETIC GOLF CLUB COVER

(76) Inventor: Alber Hot, 16 Takolusa Dr., Holmdel, NJ (US) 07733

( * ) Notice: Subject to any disclaimer, the term of this patent is extended or adjusted under 35 U.S.C. 154(b) by 206 days.

(21) Appl. No.: 11/179,927

(22) Filed: Jul. 12, 2005

(65) Prior Publication Data

US 2007/0015607 A1 Jan. 18, 2007

(51) Int. Cl.
*A63B 69/36* (2006.01)

(52) U.S. Cl. ..... 473/256; 473/226; 150/160; 273/DIG. 30

(58) Field of Classification Search ..... 473/219, 473/226, 236, 233, 256, 334, 337; 150/160; 206/315.2
See application file for complete search history.

(56) References Cited

U.S. PATENT DOCUMENTS

| | | | | |
|---|---|---|---|---|
| 2,676,803 | A | 4/1954 | Damaske | |
| 3,861,434 | A | 1/1975 | Harding | |
| 4,971,126 | A * | 11/1990 | Borenstein | 150/160 |
| 5,050,655 | A | 9/1991 | Borenstein | |
| 5,125,655 | A * | 6/1992 | Crooks | 473/206 |
| 5,441,270 | A | 8/1995 | Williams | |
| 5,615,720 | A | 4/1997 | O'Sullivan | |
| 5,725,439 | A | 3/1998 | Halsey et al. | |
| 5,952,921 | A | 9/1999 | Donnelly | |
| 6,015,354 | A | 1/2000 | Ahn et al. | |
| 6,095,930 | A | 8/2000 | Siddall | |
| 6,113,457 | A | 9/2000 | Kociemba | |
| 6,118,376 | A | 9/2000 | Regester | |
| 6,270,424 | B1 | 8/2001 | Holub | |
| 6,419,591 | B1 | 7/2002 | Addeo et al. | |
| 6,484,771 | B2 | 11/2002 | Kloos et al. | |
| 6,716,111 | B2 | 4/2004 | Liberatore | |
| 2005/0016648 | A1 | 1/2005 | Vakharla et al. | |

* cited by examiner

*Primary Examiner*—Nini F. Legesse
(74) *Attorney, Agent, or Firm*—Patterson & Sheridan, LLP

(57) ABSTRACT

A magnetic cover for a golf club iron has a surface adapted to conform to at least one plane of a face of a head of the golf club iron. In one embodiment, the magnetic cover has a first layer comprising a magnetic material and a second layer comprising a non-magnetic material. In one embodiment, the magnetic cover has at least one curved surface adapted to conform to at least one of an edge of the face, a sole of the head, and a top of the head.

8 Claims, 2 Drawing Sheets

MAGNETIC GOLF CLUB COVER

BACKGROUND OF THE INVENTION

1. Field of the Invention

The present invention generally relates to golf clubs and, more particularly, to covers for golf clubs.

2. Description of the Related Art

Golf clubs are generally carried about in a golf bag along with other golf clubs. Typically, golf clubs need protection from damage caused by knocking into other golf clubs in the bag or otherwise. Golf clubs also become dirty and misplaced when used in a game of golf and other activities. Golf club covers are typically used to protect the golf club. However, some existing golf club covers are difficult or time-consuming to install and remove. Additionally, some existing golf club covers are not effective at remaining attached to the golf club or providing adequate protection to the golf club. Some existing golf club covers also do not address the problems of missing and dirty golf clubs.

SUMMARY OF THE INVENTION

Various deficiencies of the prior art are addressed by the present invention, one embodiment of which is a magnetic cover for a golf club iron which has a surface adapted to conform to at least one plane of a face of a head of the golf club iron. In one embodiment, the magnetic cover has a first layer comprising a magnetic material and a second layer comprising a non-magnetic material. In one embodiment, the magnetic cover has at least one curved surface adapted to conform to at least one of an edge of the face, a sole of the head, and a top of the head.

In one embodiment, the magnetic cover has a third layer disposed between the first and second layers, and the third layer comprises a resilient material. In one embodiment, the magnetic cover has a second surface facing an opposite direction with respect to the direction faced by the first surface, and the second surface has at least one of an advertisement, a groove cleaner, and a sponge attached thereto.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention will be generally described within the context of a golf club. More specifically, the present invention is applicable in particular to a golf club iron 20. However, it will be appreciated by those skilled in the art that while the invention has specific utility within the context of the golf club iron 20, the invention has broad applicability to any golf club.

Figure 1:
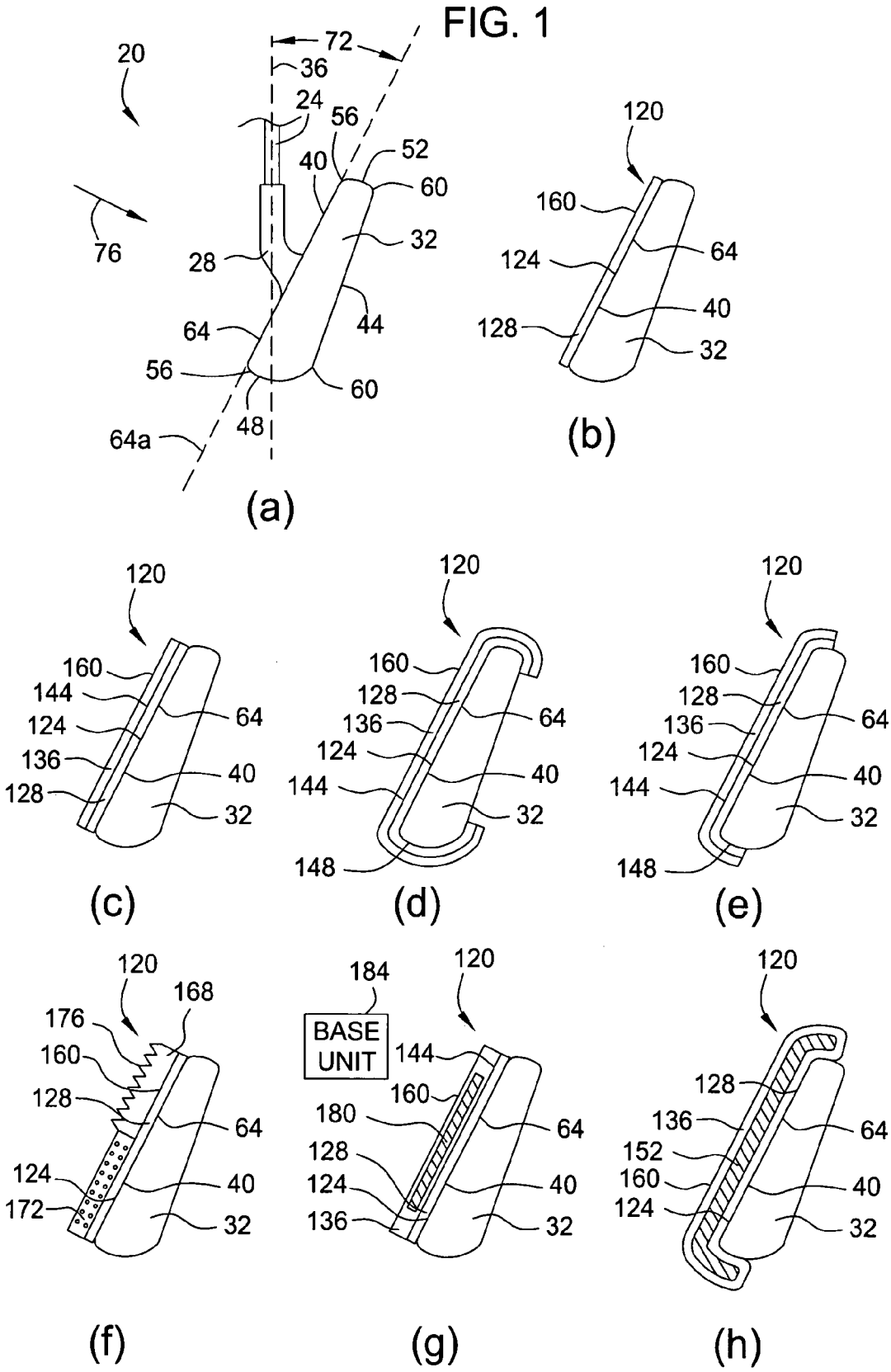
FIG. 1A depicts a side view of a golf club iron suitable for use with the present invention.
FIGS. 1B-H depict cross-sectional side views of the head of the golf club iron depicted in FIG. 1A, showing embodiments of the magnetic cover according to the present invention.

FIG. 1A depicts a side view of an embodiment of a golf club iron 20 suitable for use with the present invention. The golf club iron 20 comprises a shaft 24 connected to a hosel 28, the hosel 28 connected to a head 32. The shaft 24 illustrated in FIG. 1A is abbreviated for convenience of providing a detailed view of the head 32, but typically the shaft 24 is many times longer than the largest dimensions of the head 32 and the hosel 28. The shaft 24 has a longitudinal axis 36 which runs along the length of the shaft 24. The hosel 28 connects the shaft 24 to the head 32 and typically comprises an angled metallic member. The particular geometry of the hosel 28 orients the shaft 24 to the head 32, and can be varied to achieve various spatial relationships between the shaft 24 and head 32.

The head 32 comprises a face 40, a back 44, a sole 48 and a top 52. Generally speaking, the face 40 of the head 32 is used by a golfer to strike a golf ball. The head 32 also comprises an edge 56 along the face 40, between the face 40 and the top 52, sole 48, and a side 100 of the head 32. The head 32 also comprises another edge 60 along the back 44, between the back 44 and the top 52, sole 48, and side 100. The edges 56, 60 have varying degrees of sharpness and roundness.

The face 40 comprises at least one plane 64. As illustrated in FIG. 1A, the face 40 has a major plane 64*a* which is oriented with respect to the longitudinal axis 36 at an angle 72. The angle 72 can be varied to vary the performance characteristics of the golf club iron. Typically, the angle 72 comprises from about 20 to about 50 degrees. In one embodiment, the face 40 has at least a portion which occupies the major plane 64*a*. In another embodiment, the face 40 is flat and substantially entirely occupies the major plane 64*a*.

Figure 2:
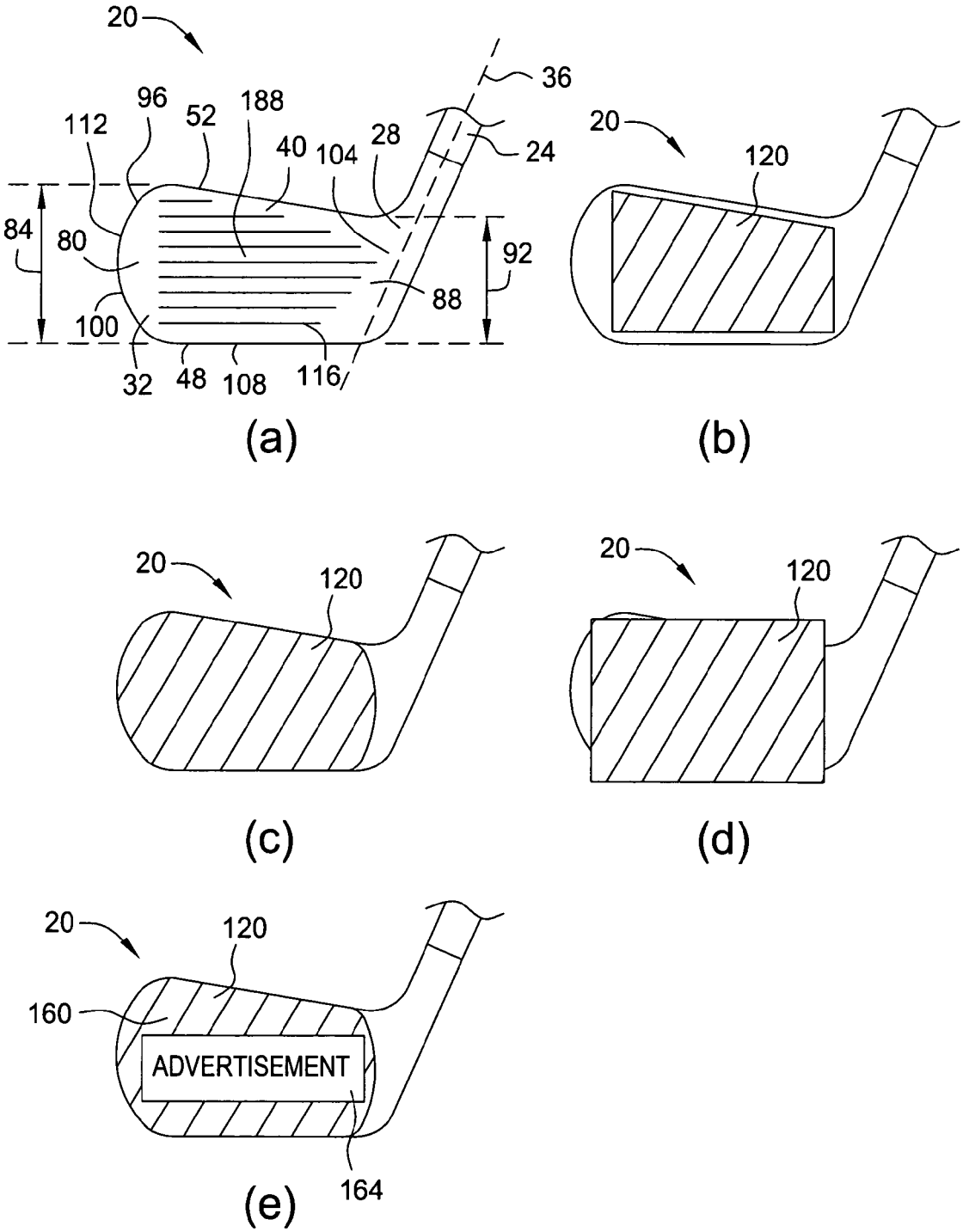
FIG. 2A depicts a front view of the golf club iron illustrated in FIG. 1A.
FIGS. 2B-E depict front views of the golf club iron illustrated in FIG. 2A, showing embodiment of the magnetic cover according to the present invention.

FIG. 2A depicts a front view of the embodiment of the golf club iron 20 illustrated in FIG. 1A. The face 40 of the head 32 has a specific shape, for example when viewed from a direction 76 perpendicular to the major plane 64*a* of the face 40. Typically the face 40 has a first end 80 which has a first characteristic dimension 84 which is greater in magnitude then a second characteristic dimension 92 of a second end 88 of the face 40. The face 40 also has an outline 96 comprising the edge 56 of the face 40 and a portion of a transition region 104 between the head 32 and the hosel 28. The outline 96 of the face 40 optionally comprises a series of geometric shapes. In one embodiment, the outline 96 comprises at least one portion which is a straight portion 108. In another embodiment, the outline 96 comprises at least one portion which is a curved portion 112.

Generally speaking, the face 40 comprises at least one groove 116. The groove 116 has a length and a depth. As illustrated in FIG. 2A, in one embodiment the face 40 comprises a plurality of grooves 116 aligned to each other.

Each groove 116 in the plurality of grooves 116 has a relative spacing to the other grooves 116. The grooves 116 in the plurality of grooves 116 optionally have varying lengths.

The golf club iron 20 is capable of being constructed in a number of ways. In one embodiment, the head 32 and the hosel 28 comprise a single monolithic structure and the shaft 24 is connected to the hosel 28. Alternatively, any of the shaft 24, hosel 28 and head 32 comprise separate structures which are attached to other of the shaft 24, hosel 28 and head 32. Generally speaking, the head 32 comprises a magnet-attracting material such as, for example, iron and steel.

According to one embodiment, the present invention comprises a magnetic cover 120 for the golf club iron 20. FIGS. 1B-H are cross-sectional side views of the head 32 depicting embodiments the magnetic cover 120. FIGS. 2B-E are front views of the golf club iron 20 depicting embodiments of the magnetic cover 120. The magnetic cover 120 protects and prevents damage to the face 40, and optionally other portions of the head 32, of the golf club iron 20.

The magnetic cover 120 comprises a layer 128 comprising a magnetic material 132. The magnetic material of the magnetic layer 128 is adapted to be a magnet, i.e. to produce a magnetic force. The magnetic layer 128, also alternatively referred to herein as the first layer 128, enables the magnetic cover 120 to be easily and quickly attached and detached to/from the face 40 because of the magnetic attraction between the magnetic material and the magnet-attracting material of the golf club iron 20.

The magnetic cover 120 comprises a surface 124 adapted to conform to at least one plane 64 of the face 40. The surface 124, also alternatively referred to herein as the first surface 124, enables the magnetic cover 120 to be attached to the face, and optionally other portions of the head 32, in a form-fitting manner. A form-fitting attachment of the magnetic cover 120 to the face 40 and head 32 maximizes the protection of the face 40 and head 32 enabled by the magnetic cover 120. In one embodiment, the surface 124 is adapted to conform to the major plane 64*a* of the face 40. In another embodiment, the surface 124 is adapted to conform to a plurality of planes 64 of the face 40. For example, the surface 124 optionally conforms to both the major plane 64*a* of the face 40 and planes 64 contained within the groove 116 of the face 40.

In one embodiment, the magnetic layer 128 comprises the surface 124 adapted to conform to at least one plane 64 of the face 40. An advantage of such an embodiment is that the magnetic material of the magnetic layer 128 is located as close as possible to the magnet-attracting material of the head 32, which maximizes the magnetic attraction between the magnetic cover 120 and the golf club iron 20.

FIG. 1B depicts an embodiment of the magnetic cover 120 having a single layer 128 comprising the magnetic layer 128 The single layer 128 of the embodiment of the magnetic cover 120 illustrated in FIG. 1B also comprises the surface 124 adapted to conform to at least one plane 64 of the face 40.

In one embodiment, the cover 120 comprises a layer 136 comprising a non-magnetic material 140. The non-magnetic layer 136, also referred to herein as the second layer 136, can comprise a structure upon which the magnetic layer 128 is conveniently formed. For example, in one embodiment, the non-magnetic layer 136 comprises a material which is easier or cheaper to shape and form into a desired structure than the magnetic material 128. In one embodiment, the non-magnetic material comprises at least one of plastic and rubber. One advantage to the non-magnetic material comprising rubber is the durability of rubber.

FIG. 1C depicts an embodiment of the magnetic cover comprising both the magnetic layer 128 and the non-magnetic layer 136. In the embodiment illustrated, the magnetic layer 128 comprises the surface 124 adapted to conform to at least one plane 64 of the face 40, and the non-magnetic layer 136 is connected to the magnetic layer 128 at an interface 144 between the magnetic 128 layer and the non-magnetic layer 136.

In one embodiment, the interface 144 between the magnetic layer 128 and the non-magnetic layer 136 comprises a discrete interface 144. For example, in a first version of such an embodiment, the magnetic layer 128 ends at the interface 144 and the non-magnetic layer 136 begins thereafter. In a second version of an embodiment having the discrete interface 144, the interface 144 comprises a bonding agent between the magnetic layer 128 and the non-magnetic layer 144. For example, the bonding agent optionally comprises at least one of a glue and a resin.

In another embodiment, the interface 144 between the magnetic layer 128 and the non-magnetic layer 136 comprises a material gradient, over the course of which material of the magnetic cover gradually transitions from the magnetic material to the non-magnetic material. In this embodiment, there is no discreet interface 144 between the magnetic material 128 and the non-magnetic material 140. In one version of such an embodiment, the magnetic cover 120 comprises a monolith.

Generally speaking, the various embodiments of the interface 144 are advantageously related to particular manufacturing processes used to create the magnetic cover 120.

In one embodiment, the magnetic cover 120 comprises at least one curved surface 148 adapted to conform to at least one of the edge 56 of the face 40, the sole 48 of the head 32, and the top 52 of the head 32. The curved surface 148 provides protection to the portion of the edge 56, sole 48 and top 52 to which the curved surface 148 is adapted to conform. In one embodiment, the curved surface 148 enables a more secure attachment of the magnetic cover 120 to the head 32. FIG. 1D depicts one version of this embodiment in which the curved surface 148 is adapted to conform to the edge 56 of the face 40, the sole 48, the top 52, and the edge 60 of the back 44. FIG. 1E depicts another version of this embodiment in which the curved surface 148 is adapted to conform to the edge 56 of the face 40 and at least a portion of at least one of the sole 48 and the top 52.

In one embodiment, the curved surface 148 is contiguous with the first surface 124. One advantage of this embodiment is that the magnetic cover 120 has a more exact fit to the head 32. Alternatively, in another embodiment there is a disjointed region, edge, or bevel between the curved surface 148 and the first surface 124. An advantage of this embodiment may be a reduced cost of manufacturing the magnetic cover 120.

The curved surface 148 is optionally flexible. In one embodiment, the flexibility of the curved surface 148 increases the ease with which the magnetic cover 120 is attached to the golf club iron 20.

The magnetic cover 120 optionally comprises a layer 152, disposed between the magnetic 128 and non-magnetic layers 136, comprising a resilient material. FIG. 1H depicts one embodiment of the magnetic cover 120 having the resilient layer 152, also referred to herein as the third layer 152. The resilient layer 152 further enables the magnetic cover 120 to protect the face 40 and portions of the edge 56, sole 48 and top 52. In one embodiment, the resilient layer 152 acts as a shock absorber between the magnetic layer 128 and the non-magnetic layer 136 to at least partially absorb a blow inflicted upon the golf club iron 20, for example, by other golf clubs in a golf bag. In one embodiment, the resilient material also enables the magnetic cover 120 to substantially resume its original shape after sustaining a blow, thus prolonging the useful product life of the magnetic cover 120. In one embodiment, the resilient material comprises at least one of a spongy rubber and neoprene.

The non-magnetic material is optionally adapted to have a specific hardness to enhance the protection of the face 40 and head 32 of the golf club iron 20. For example, in one embodiment in which the magnetic cover 120 comprises the resilient layer 152 disposed between the magnetic layer 128 and the non-magnetic layer 136, the non-magnetic material is adapted to have a predetermined hardness as measured on the type D durometer scale of the American Society for Testing and Material (ASTM) specification ASTM D2240. In one version of this embodiment, the non-magnetic material comprises a hard rubber.

The magnetic cover 120 optionally comprises at least one of an advertisement 164, a groove cleaner 168, and a sponge 172 attached to a second surface 160 which faces an opposite direction with respect to the direction faced by the first surface 124. In one embodiment, the second surface 160 faces outwardly from the head 32 when the magnetic cover 120 is attached to the face 40. FIG. 1F depicts one embodiment in which the magnetic cover 120 comprises both the groove cleaner 168 and the sponge 172 attached to the second surface 160. FIG. 2E depicts one embodiment of the magnetic cover 120 comprising the advertisement 164 attached to the second surface 160. The second surface 160 is optionally a surface of at least one of the magnetic layer 128 and the non-magnetic layer 136.

The groove cleaner 168 comprises at least one protrusion 176 which, when inserted into the groove 116 of the face 40, can be used to clean debris and particles from the groove 116. Such debris and particles may accumulate in the groove 116 during use of the golf club iron 20 and can adversely affect the performance of the golf club iron 20.

The sponge 172 is capable of generally cleaning any surface of the golf club iron 20. For example, the sponge 172 can be used to clean any part of the head 32, hosel 28, and shaft 24. The sponge 172 can also be wet with water or another cleaning fluid to facilitate cleaning portions of the golf club iron 20. In one embodiment, the opposing second surface 160 is bendable and is adapted to be used by the golfer to wring the cleaning fluid from the sponge 172 by bending the second surface 160 to squeeze the cleaning fluid from the sponge 172.

The advertisement 164 is attached to the opposing second surface 160 by at least one of being printed thereon and being attached thereto as a label. In one embodiment, the advertisement 164 comprises a silk-screen print. In another embodiment, the advertisement 164 comprises a sticker. The advertisement 164 is attached to at least a portion of the second surface 160.

The magnetic cover 120 is optionally adapted to be used as a swing practice aid. In one embodiment, the weight of the magnetic cover 120 is adapted to have a predetermined value designed to be useful in aiding the golfer with swing practice. For example, in one version of this embodiment, the weight of the magnetic cover 120 has a value which is a predetermined percentage of the weight of the golf club iron 20. In another embodiment, the magnetic cover 120 is adapted to generate a magnetic force that is sufficient to hold the magnetic cover 120 on the golf club iron 20 during swing practice. For example, in one version of this embodiment, the magnetic cover 120 is adapted to generate the magnetic force which is sufficient to hold the magnetic cover 120, having a weight which is a predetermined percentage of the weight of the golf club iron 20, on the golf club iron 20 while the head 32 is traveling at up to a predetermined speed while being swung by the golfer.

The magnetic cover 120 optionally comprises a sensor 180 adapted to be used in conjunction with a base unit 184. FIG. 1G depicts one embodiment in which, for example, the sensor 180 is embedded in the non-magnetic layer 136. The sensor 180 operates in conjunction with the base unit 184 to indicate if the sensor 180, and thus the magnetic cover 120, has become separated from the base unit 184 by a predetermined distance. In one embodiment, the sensor 18 is capable of causing the base unit 184 to cause an alarm to sound as an indication. The base unit 184 can be located, for example, in at least one of the golf club bag, on the golfer, in apparel or at a club house. In one embodiment, the sensor 180 comprises an RFID tag. One advantage to the sensor 180 comprising the RFID tag is that the RFID tag does not need its own power source. An additional advantage to the sensor 180 comprising an RFID tag is that the RFID tag typically has a flat geometry which can be conveniently embedded in the non-magnetic layer 136.

FIGS. 2B-D depict embodiments of the magnetic cover 120 having particular shapes. FIG. 2C depicts one embodiment of the magnetic cover 120 in which the magnetic cover 120 has a first surface 124 which has substantially the same size and shape as the face 40. FIG. 2B depicts one embodiment of the magnetic cover 120 in which the magnetic cover 120 has a first surface 124 having a size and shape which is adapted to attach to and occupy only a portion of the face 40. FIG. 2D depicts one embodiment of the magnetic cover 120 in which the magnetic cover 120 has a first surface 124 which has a geometric shape which is different than the shape of the face 40. For example, in one version of this embodiment, the geometric shape comprises at least one of a square, a rectangle, a circle, and an oval. One advantage of such an embodiment is to decrease the cost of manufacture of the magnetic cover 120.

It is believed that the magnetic cover 120 may enhance a sweet spot 188 of the golf club iron 20. The sweet spot 188 of the golf club iron is an optimum location on the face 40 with which to hit the golf ball. The sweet spot 188 can comprise different locations on different golf club irons 20. Generally speaking, the sweet spot 188 is related to various design factors of the head 32. For example, the sweet spot 188 can depend upon the distribution of weight within the head 32.

While the foregoing is directed to embodiments of the present invention, other and further embodiments of the invention may be devised without departing from the basic scope thereof, and the scope thereof is determined by the claims that follow. Various embodiments presented herein, or portions thereof, may be combined to create further embodiments. For example, one version of the embodiment in which the magnetic cover 120 comprises a single layer 128, which is the magnetic layer 128, also comprises the at least one curved surface 148. Furthermore, terms such as top, side, bottom, front, back, and the like are relative or positional terms and are used with respect to the exemplary embodiments illustrated in the figures, and as such these terms may be interchangeable.

The invention claimed is:

1. A magnetic cover for a golf club iron, the golf club iron comprising a head having a face, the magnetic cover comprising:

a surface having a shape that conforms to at least one plane of the face;

a first layer comprising a magnetic material;

a second layer comprising a non-magnetic material;

at least one curved surface having a shape that conforms to at least one of an edge of the face, a sole of the head, and a top of the head; and a sensor which operates in conjunction with a base unit to indicate if the sensor has become separated from the base unit by a predetermined distance.

2. The magnetic cover of claim 1, wherein the sensor causes the base unit to emit an alarm as indication that the sensor has become separated from the base unit by the predetermined distance.

3. The magnetic cover of claim 1, wherein the sensor is an RFID tag.

4. The magnetic cover of claim 3, wherein the RFID tag is embedded in the second layer.

5. The magnetic cover of claim 1, wherein the at least one curved surface is flexible.

6. The magnetic cover of claim 1, wherein the at least one curved surface is contiguous with the surface having the shape that conforms to at least one plane of the face.

7. The magnetic cover of claim 1, wherein the non-magnetic material has a hardness having a predetermined value as measured on the type D durometer scale of the American Society for Testing and Material (ASTM) specification D2240.

8. The magnetic cover of claim 1, wherein the non-magnetic material comprises at least one of plastic and rubber.

* * * * *